US011623781B2

(12) United States Patent
Lischetzki et al.

(10) Patent No.: US 11,623,781 B2
(45) Date of Patent: Apr. 11, 2023

(54) CONTAINER WITH CORRUGATIONS

(71) Applicant: BASF SE, Ludwigshafen am Rhein (DE)

(72) Inventors: Peter Lischetzki, Limburgerhof (DE); Tom Reinhardt, Limburgerhof (DE); Harald Kroeger, Limburgerhof (DE); Robert Huber, Limburgerhof (DE)

(73) Assignee: BASF SE, Ludwigshafen am Rhein (DE)

( * ) Notice: Subject to any disclaimer, the term of this patent is extended or adjusted under 35 U.S.C. 154(b) by 808 days.

(21) Appl. No.: 16/485,206

(22) PCT Filed: Feb. 2, 2018

(86) PCT No.: PCT/EP2018/052615
§ 371 (c)(1),
(2) Date: Aug. 30, 2019

(87) PCT Pub. No.: WO2018/149661
PCT Pub. Date: Aug. 23, 2018

(65) Prior Publication Data

US 2020/0071016 A1 Mar. 5, 2020

(30) Foreign Application Priority Data

Feb. 14, 2017 (EP) ..... 17156091

(51) Int. Cl.
*B65D 1/02* (2006.01)
*B65D 1/44* (2006.01)

(52) U.S. Cl.
CPC ..... *B65D 1/0223* (2013.01); *B65D 1/0207* (2013.01); *B65D 1/44* (2013.01); *B65D 2203/04* (2013.01); *B65D 2501/0036* (2013.01)

(58) Field of Classification Search
CPC ..... B65D 2501/0036; B65D 1/44; B65D 1/0207; B65D 1/0223
(Continued)

(56) References Cited

U.S. PATENT DOCUMENTS 5,067,622 A * 11/1991 Garver ..... B29C 49/64 215/381
6,929,139 B2 * 8/2005 Darr ..... B29C 49/0073 220/675

(Continued)

FOREIGN PATENT DOCUMENTS

CH 274793 A 4/1951
DE 871253 C 3/1953

(Continued)

OTHER PUBLICATIONS

International Search Report for International Application No. PCT/EP2018/052615, dated Apr. 23, 2018, 3 pages.
Pending U.S. Appl. No. 16/472,454, filed Jun. 21, 2019.

*Primary Examiner* — Ernesto A Grano
(74) *Attorney, Agent, or Firm* — Armstrong Teasdale LLP

(57) ABSTRACT

The present invention relates to a container with a side wall of plastic encloses a container volume. Horizontally oriented grooves spaced vertically apart from one another are formed in the side wall, and the grooves include first grooves for stiffening the side wall. The first grooves have a first groove depth and are configured such that a projection protruding into the enclosed container volume is formed in the inner surface of the side wall. The grooves also include second grooves having a second groove depth. The first groove depth is greater than the second groove depth. The first and second grooves are arranged such that at least one second groove is in each case arranged in the vertical direction between two first grooves. The subvolumes enclosed by two (Continued)

Figure 1:
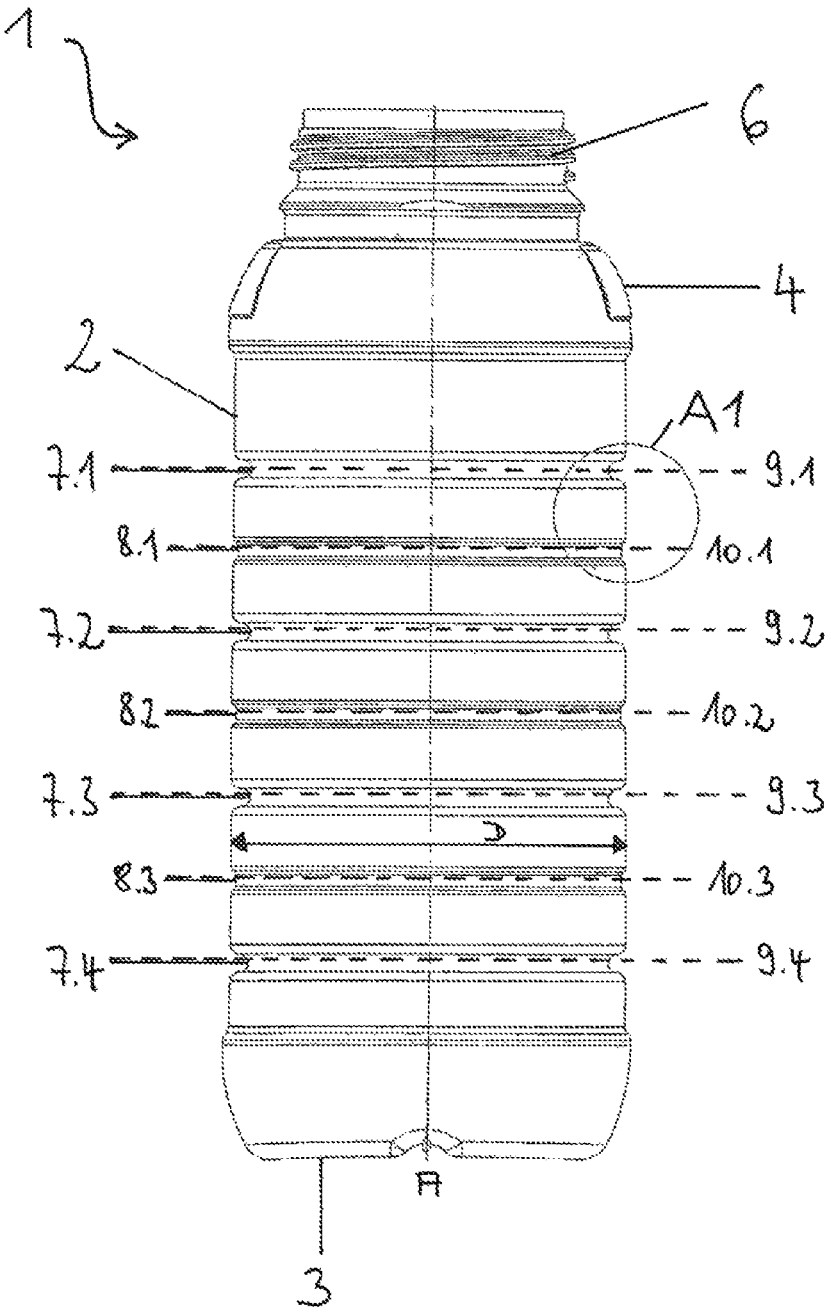

horizontal planes, which are defined by two adjacent grooves, and the side wall are in each case identical.

20 Claims, 3 Drawing Sheets

(58) Field of Classification Search
USPC ..... 215/382
See application file for complete search history.

(56) References Cited

U.S. PATENT DOCUMENTS

| | | | | |
|---|---|---|---|---|
| 7,051,890 | B2 * | 5/2006 | Onoda | B65D 1/44 220/675 |
| D611,345 | S | 3/2010 | Bangi et al. | |
| 7,798,349 | B2 * | 9/2010 | Maczek | B65D 79/0084 215/381 |
| 8,496,130 | B2 * | 7/2013 | Lane | B65D 1/0261 215/381 |
| 8,556,098 | B2 * | 10/2013 | Peykoff | B65D 1/44 215/381 |
| 11,220,368 | B2 * | 1/2022 | Hanan | B65D 1/0284 |
| 2002/0148841 | A1 | 10/2002 | Elich et al. | |
| 2005/0045657 | A1 | 3/2005 | Smiley | |
| 2008/0197105 | A1 * | 8/2008 | Boukobza | B65D 1/0223 215/381 |
| 2010/0155359 | A1 * | 6/2010 | Simon | B65D 79/0084 220/675 |
| 2013/0102989 | A1 | 4/2013 | McCoy et al. | |
| 2015/0129536 | A1 | 5/2015 | Moulin | |
| 2019/0062026 | A1 * | 2/2019 | Pritchett, Jr. | B67C 7/00 |
| 2019/0200599 | A1 | 7/2019 | Brix et al. | |
| 2020/0071016 | A1 * | 3/2020 | Lischetzki | B65D 1/0207 |
| 2020/0189784 | A1 * | 6/2020 | Nakayama | B65D 1/0223 |

FOREIGN PATENT DOCUMENTS

| | | | |
|---|---|---|---|
| EP | 2319771 | A1 | 5/2011 |
| EP | 3072825 | A1 | 9/2016 |
| FR | 3028032 | A3 | 5/2016 |
| JP | S50011963 | U | 6/1948 |
| JP | 2001213418 | A | 8/2001 |

* cited by examiner

CONTAINER WITH CORRUGATIONS

CROSS-REFERENCE TO RELATED APPLICATIONS

This application is a U.S. National Phase Application of PCT/EP2018/052615, filed Feb. 2, 2018, which claims the benefit of priority to EP Application No. 17156091.5, filed Feb. 14, 2017, the contents of which are hereby expressly incorporated by reference in their entirety.

The present invention relates to a container with a side wall of plastic which encloses a container volume, wherein horizontally oriented grooves spaced vertically apart from one another are formed in the side wall, and wherein the grooves comprise first grooves for stiffening the side wall, which first grooves have a first groove depth and are configured such that a projection protruding into the enclosed container volume is formed in the inner surface of the side wall.

Containers made of deformable materials, for example plastic containers, often have to be stabilized against deformation. Containers of this kind may be deformed, for example, by negative pressure, which develops in the interior of a closed container, or by manual compression, for example during transportation. Stabilization of the container against deformation is therefore sensible or necessary from several points of view. On the one hand, the stability is increased, as a result of which the risk of damage is reduced. On the other hand, it is important that the container is esthetically pleasing. For example, it should not show signs of deformation in the form of dents.

EP 2 319 771 A1 describes, in its introductory part, the problem of a thin-walled plastic bottle deforming unpredictably when the internal pressure decreases. The aim is to avoid such random deformation. EP 2 319 771 A1 proposes a solution to this problem in which a groove is provided between an upper part and a lower part of the bottle. When a negative pressure is present in the container, this groove deforms in the axial direction, such that the upper part of the bottle is moved axially in the direction of the lower part of the bottle. In the lower part of the bottle, ribs are moreover arranged which serve to stiffen the wall of the bottle. In addition, however, they also serve the purpose of absorbing a residual negative pressure during the contraction and deformation of the bottle in the axial direction, which residual negative pressure cannot be completely compensated by the deformation of the groove. Thus, the ribs in the lower part of the bottle also deform at a negative pressure. This has the effect that the subvolumes enclosed by two horizontal planes, which are defined by two adjacent grooves, and the side wall of the bottle vary according to the negative pressure in the bottle.

It is also known for containers to be stabilized by stiffening elements. For this purpose, in the process of manufacturing of the container, horizontal stiffening elements, for example, are introduced into the container wall in order to counteract deformation in the vertical direction or to counteract dents in the radial direction.

A container should be designed to be sufficiently stable for the desired field of use. At the same time, however, for reasons relating to cost and weight, the least possible amount of plastic should be employed in many fields of use. For this reason, instead of having stiffening elements in the form of stabilizing projections in the outer wall of the container, it is also possible to form stiffening grooves which, in the inner surface of the side wall of the container, form a projection protruding into the enclosed container volume, since in this case less plastic is needed to form the side wall. However, it has unfortunately been found that the run-off properties of such containers are poorer as a result, such that the container is potentially unable to be completely emptied. This is very disadvantageous for some products, since it is not possible to make use of the entire product received in the container. Moreover, the container may potentially have to be cleaned at great cost for reuse or disposal. This is a considerable disadvantage, for example, if the container is intended to receive a crop protection agent.

Containers are also known in which a scale division is applied. Such a scale division makes it easier for the user to pour or empty out defined subvolumes from the container.

US 2005/0029220 A1 describes a container in the form of a cylindrical bottle produced from a plastic resin. It has spiral-shaped or horizontal grooves which serve to stiffen the container. In the case of horizontal grooves, these are in one embodiment arranged equidistant from each other in the vertical direction. The distances between the grooves are chosen, depending on the diameter of the container, such that there is no deformation of the side wall of the container at a negative pressure of 350 mmHg in the interior of the bottle. Such a negative pressure occurs, for example, when a container is filled with hot content and closed and the content of the container then cools. In one embodiment, the grooves extend completely around the container and, in a further embodiment, they have a cross section in the shape of a truncated cone.

A further container in which a contained volume of liquid can be indicated by grooves is described in CH 274793 A.

The object of the present invention is to make available a stable container which has a scale division and in which the run-off properties are at the same time optimized.

According to the invention, this object is achieved by a container having the features of claim 1. Advantageous embodiments and developments are set forth in the dependent claims.

The container according to the invention is characterized in that the grooves comprise second grooves which have a second groove depth, wherein the first groove depth is greater than the second groove depth, the first and second grooves are arranged such that at least one second groove is in each case arranged in the vertical direction between two first grooves, and the subvolumes enclosed by two horizontal planes, which are defined by two adjacent grooves, and the side wall are in each case identical. In this way, the grooves of the container form a scale for the volume received by the container.

To form a finely graduated scale, it is in most cases necessary to have more grooves than the first grooves ("stiffening grooves") that should at least be present to ensure that the container is adequately stiffened and thus stable. In the container according to the invention, the addition of second grooves ("intermediate grooves") ensures that, even with a small number of necessary stiffening grooves, a finely graduated scale is formed with which it is also possible to measure off smaller subvolumes of the container. In this case, the stiffening grooves are only part of the scale, said scale being completed by the second, shallower grooves. By virtue of the second groove depth being shallower than the first groove depth, it is advantageously possible to reduce the resistance which holds back some of the container content when the content is being poured or emptied out, since the shallower grooves hold back a smaller amount of the container content than the deeper stiffening grooves. Thus, the container according to the invention can be variably adapted such that it in particular also has a finely graduated scale division, and the run-off properties are optimized at the same time.

A further advantage of the container according to the invention is that the surface of the container has no protruding structural elements. The formation of such structural elements would in fact have the disadvantage that they could become rubbed off during use of the container. The scale would then no longer be easy to read over the course of time.

Yet another advantage of the container according to the invention is the fact that, in the shallower grooves compared with the deeper stiffening grooves, the plastic is thinned out less and, consequently, the barrier to water vapor or oxygen, for example, is increased, without increasing the wall thickness and therefore the weight of the container.

The container according to the invention can therefore satisfy very different and sometimes contradictory requirements. By virtue of the first grooves, the container can be stiffened such that it acquires sufficient stability, even when the side wall has a small wall thickness. At the same time, a scale can be made available by the entirety of the grooves, and the additional second grooves, which are not necessary for stiffening the side wall, do not impair the pouring or emptying properties of the container, and at the same time the amount of material used for the side wall of the container is not increased.

In one embodiment, the subvolume enclosed by a container base, the side wall and a horizontal plane defined by the lowermost groove can be an integer multiple of the subvolume enclosed by two horizontal planes, which are defined by two adjacent grooves, and the side wall. In this way, identical subvolumes are enclosed between two adjacent grooves. Although the subvolume enclosed by the base and the lowermost groove can be identical to this subvolume, it can also be chosen to be greater. However, this lowermost subvolume is an integer multiple of the subvolumes between the grooves. An integer multiple is thus understood as multiplication by a natural number, including multiplication by the number 1. This division is advantageous if no stabilizing grooves are needed in the lower part of the container, but a scale that can be intuitively identified by the user is to be made available by the grooves.

In one embodiment of the container, the side wall is transparent or translucent, at least in the region of the horizontally oriented grooves spaced vertically apart from one another. For example, the side wall can have a vertically oriented transparent or translucent strip, which is crossed by the horizontally oriented grooves. However, the side wall of the container is preferably fully transparent or translucent. The filling level in the interior of the container can in this way be seen from the outside, such that the ribs can be used as a scale.

In one embodiment of the container, two adjacent first grooves are in each case at a vertical distance a from each other. The condition $0.10\ D \leq a \leq 0.30\ D$, preferably $0.15\ D \leq a \leq 0.25\ D$, is met for the vertical distance a, wherein D is the greatest possible horizontal internal extent inside the container in the region of the vertical distance a between the two adjacent grooves. In the case of a circular cylindrical container, the greatest possible horizontal internal extent is the internal diameter of the container. With this geometry of the container, it is possible, for many plastic materials, to ensure a sufficient stability of the container at a small wall thickness.

In the container according to the invention, the distance and therefore the number of required first grooves, i.e. stiffening grooves, can thus be determined depending on the greatest possible horizontal internal extent inside the container in the region of the vertical distance a between the two adjacent grooves. In this way, only as many stiffening grooves are provided as are necessary for the stability of the container.

Moreover, it is then advantageously possible to add as many second grooves as are necessary for forming a desired finely graduated scale.

In one embodiment of the container, the condition $0.01\ D \leq t\mathbf{1} \leq 0.10\ D$, preferably $0.03\ D \leq t\mathbf{1} \leq 0.07\ D$, is met for the first groove depth t1, wherein D is the greatest possible horizontal internal extent inside the container in the region of the vertical distance a between the two adjacent grooves.

In the container according to the invention, the groove depths of the first grooves can thus be determined depending on the greatest possible horizontal internal extent inside the container in the region of the vertical distance a between the two adjacent grooves. For the stiffening grooves in particular, the groove depth is important as regards the resulting stiffening effect, since deeper grooves stiffen the container more strongly than shallower grooves.

In one embodiment of the container, the condition $0.005\ D \leq t\mathbf{2} \leq 0.05\ D$, preferably $0.01\ D \leq t\mathbf{2} \leq 0.03\ D$, is met for the second groove depth t2, wherein D is the greatest possible horizontal internal extent inside the container in the region of the vertical distance a between two adjacent grooves.

Moreover, in the container according to the invention, the groove depths of the second grooves can be determined depending on the greatest possible horizontal internal extent inside the container in the region of the vertical distance a between the two adjacent grooves. By contrast, in the additional second grooves that merely serve to form a scale, it is all the better the shallower the groove, since shallower grooves hold back a smaller amount or even no amount at all of the container content when the latter is poured or emptied from the container. In this way, the groove depths can advantageously be determined such that an ideal ratio of the groove depths is obtained.

In one embodiment of the container, the side wall of the container has a circular cross section. In this case, the variable D is the internal diameter of the side wall between the grooves.

The container according to the invention is preferably a circular cylindrical container. Circular cylindrical containers are the most common shape of container offered to the consumer and are distinguished by good run-off properties compared to containers with polygonal cross sections, in which the product received by the container remains in the edges, and dirt can easily accumulate there and can be less easily rinsed away.

However, according to another configuration, the container according to the invention can also have a square or rectangular cross section.

In one embodiment of the container, the first grooves are arc-shaped at the first groove depth. At the groove depth, the first grooves have in particular the shape of a segment of a circle. Moreover, they can also have a V shape there or an elliptic shape. This ensures that less material is held back at the round grooves than in the case of containers with grooves that have edges. In this way, the run-off properties of the container content are advantageously improved. Moreover, less dirt accumulates in the edge-free grooves than in grooves with edges.

In one embodiment of the container, the first grooves have the contour of a circle segment at the first groove depth. In this way too, the run-off properties when pouring out or emptying out the container content are further improved, and soiling of the inner surface is avoided.

In one embodiment of the container, the ratio of the first groove depth to the radius of the circle of the circle segment of the first grooves is in a range of 1.5 to 2.5. In the container according to the invention, an ideal groove depth can be determined according to the radius of the circle segment of the first grooves. In this way, the grooves can advantageously be configured such that the smallest possible amount of the container content, if any, is held back when pouring or emptying out the container content, and the run-off properties are thus optimized.

In one embodiment of the container, the projection, which is formed from one of the first grooves and which in the inner surface of the side wall protrudes into the enclosed container volume, has a rounded transition to the inner surface of the side wall. This ensures that no edges are formed at which material is held back when the container content is poured out. Soiling can also be reduced by this means.

In one embodiment of the container, each of the grooves is configured as a closed ring in the side wall. In the container according to the invention, the first and also the second grooves thus surround the side wall of the container completely. In this way, the first grooves (stiffening grooves) advantageously stabilize the container particularly effectively. As regards the formation of a scale through the interaction of the first and second grooves, it is also advantageous that the grooves each completely surround the side wall, since the scale is then visible and can be read off at each point of the container. Furthermore, a scale can be applied on the label of the container. Since the positioning of the label is in most cases not defined, the surrounding grooves permit flexible application of the label with a simultaneous scaling function.

In one embodiment of the container, at a hardness of the plastic from which the side wall is made in a range of 750 MPa to 1500 MPa and an internal diameter of the side wall between two grooves in a range of 87.5 mm to 89.5 mm, the first groove depth is in a range of 3 mm to 5 mm. The hardness of the plastic is indicated by the elastic modulus, also referred to as Young's modulus.

In the container according to the invention, it is thus ensured that the necessary groove depth of the stiffening grooves can be determined according to the hardness of the plastic and the dimensions of the container (internal diameter of the side wall). The stability of the container can be advantageously optimized in this way.

In one embodiment of the container, the plastic from which the side wall is made is composed of high-density polyethylene (HDPE) or the side wall is made of co-extruded plastic films (COEX). In this way, the container according to the invention can be produced simply and cost-effectively. However, the container can also undergo other processing steps such as fluorination.

In one embodiment of the container, the thickness of the side wall is substantially constant at and between the grooves. In this way, a high degree of stability of the container can advantageously be achieved with low consumption of material.

In one embodiment of the container, the ratio of the thickness of the side wall to the internal diameter of the side wall between the grooves is in a range of 0.008 to 0.013.

In the container according to the invention, the thickness of the side wall can thus be adapted in ratio to the internal diameter of the side wall between the grooves. In this way, a high degree of stability of the container can advantageously be achieved with low consumption of material.

In one embodiment of the container, the first grooves stiffen the side wall of the container in such a way that no deformations of the container occur at a uniform wall thickness and a negative pressure of 0.5 bar.

In one embodiment of the container, the side wall with the grooves is configured such that the side wall is not deformed when there is a negative pressure in the enclosed container volume. Even if there is a pressure of 1 atm (1013.25 bar), for example, acting on the side wall, the side wall is not deformed. In particular, the grooves are also not deformed. In particular, there is no deformation of the grooves in the axial direction. The subvolumes enclosed by two horizontal planes, which are defined by two adjacent grooves, and the side wall thus in each case remain identical, even when there is a negative pressure in the enclosed container volume, such that a differential pressure acts on the container wall from the outside. This differential pressure acts in the sense of reducing the enclosed container volume. The grooves of the container can in this way provide a scale for the volume received by the container even when the enclosed container volume has a negative pressure.

If the container is filled with a hot container content, a negative pressure can arise when the container is closed and the container content then cools. In the container according to the invention, a deformation can be prevented in this case.

In the present case, the container can also be filled with an agricultural formulation. After closure of the container, this reacts with the oxygen of the air which is enclosed in that region of the container not filled with the agricultural formulation. The consumption of oxygen in this chemical reaction results in a negative pressure. The container according to the invention is in particular configured such that it suffers no deformations at this negative pressure.

In one embodiment of the container, a recloseable opening is formed above the uppermost groove. The container content can be removed from the container via the opening, which can then be closed again, e.g. by a lid, such that the content of a partially emptied container can also be stored over a long period of time.

The terms horizontal and vertical, as used in this document, relate to the orientation of the container for its intended purpose. In this case, the base of the container is in particular directed downward, and the plane formed by a groove is oriented horizontally, such that a liquid received in the container is oriented parallel to this horizontal plane.

The invention is now explained in detail on the basis of the following illustrative embodiment and with reference to the drawings.

Figure 2:
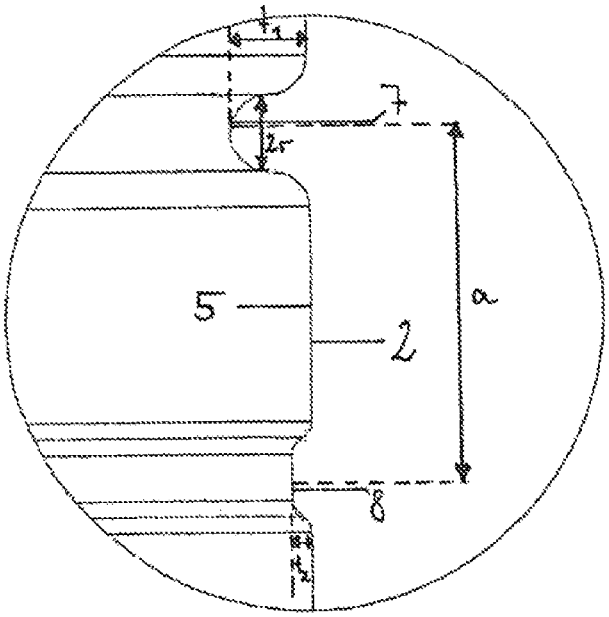
Figure 3:
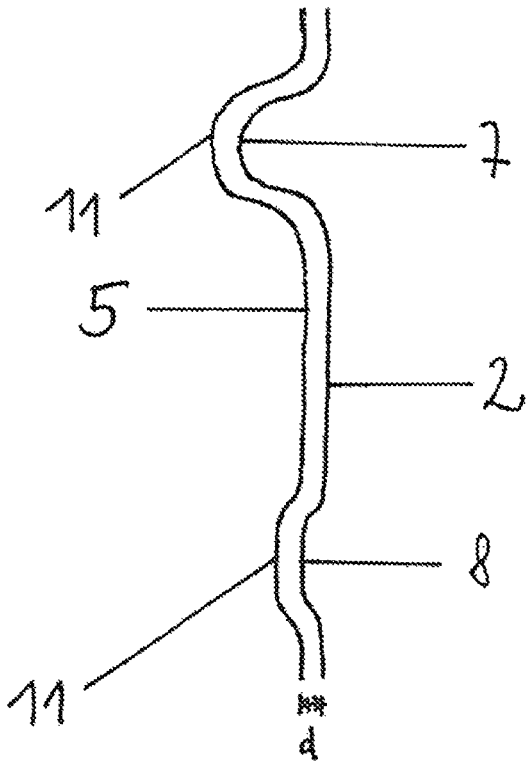

FIG. 1 shows a schematic view of the container 1 according to the invention, and FIG. 2 shows an enlarged detail A1 from FIG. 1 in order to illustrate the configuration of the first and second grooves, and FIG. 3 shows a sectional view of part of the container according to the invention in order to illustrate the configuration of the first and second grooves as projections protruding into the enclosed container volume.

The cylindrical container 1 according to the invention as shown in FIG. 1 is made of high-density polyethylene (HDPE). It is rotationally symmetrical about the axis A and comprises a circular container base 3 and a cylindrical side wall 2. At the upper end of the side wall 2, a tapering shoulder 4 leads into an opening 6 which is recloseable, for example by a lid with a screw thread, and through which a content of the container can be removed.

The side wall 2 is translucent and has four horizontally oriented first grooves 7.1-7.4 which serve to stiffen the side wall 2 ("stiffening grooves"). The first grooves 7.1-7.4 are also designated generally by 7. Furthermore, the side wall 2 has three horizontally oriented second grooves 8.1-8.3, also designated generally by 8, wherein the grooves 7, 8 are each arranged at a vertical distance a from each other (see FIG. 2). The grooves 7 and 8 are arranged alternating with each other, i.e. there is always a second groove 8 arranged above a first groove 7 and there is always a first groove 7 arranged above a second groove 8, until the arrangement terminates at a first or a second groove 7, 8. The sequence of the grooves can start at a first groove 7 or a second groove 8.

With other container volumes and other container diameters, it is also possible to provide a different number of first and/or second grooves 7, 8. Moreover, it is also possible for several second grooves 8 to be arranged between two first grooves 7.

Each groove 7, 8 extends around the side wall 2 as a closed ring. Through the arrangement of the first grooves 7 ("stiffening grooves"), the side wall 2 of the container 1 is stiffened in such a way that, with a uniform wall thickness and a negative pressure of 0.5 bar, no deformation of the container 1 occurs.

FIG. 1 also shows the horizontal planes 9.1-9.4 which are defined by the first grooves 7, and the horizontal planes 10.1-10.3 which are defined by the second grooves 8. In the container 1 according to the invention, two adjacent horizontal planes 9, 10 each enclose identical subvolumes with the side wall 2 of the container 1. Moreover, the subvolume enclosed by the lowermost horizontal plane 9.4, which is defined by the lowermost groove 7.4, the container base 3 and the side wall 2 is an integer multiple of the further above-described subvolumes. Consequently, the arrangement of the grooves 7, 8 and of the associated planes 9, 10 results in a finely graduated scale for the volume received by the container 1, with the aid of which scale the above-described subvolumes of the container content can be measured off and removed from the container 1.

FIG. 1 also shows the greatest possible horizontal internal extent D inside the container 1 in the region of the vertical distance a between the two adjacent grooves 7, 8. In the present illustrative embodiment, this variable corresponds to the internal diameter of the cylindrical container 1.

FIG. 2 moreover shows the inner surface 5 of the container 1, and also the groove depth t1 and the radius r of the circle segment of the first grooves 7, and also the groove depths t2 of the second grooves 8. FIG. 3 shows the thickness d of the side wall 2 of the container 1 with the projections 11 which are formed by the grooves 7, 8 and which protrude into the enclosed container volume. The projections 11 are configured such that they have a rounded transition to the inner surface 5 of the side wall 2. The thickness d of the side wall 2 of the container 1 is substantially constant at each point of the container 1.

The illustrative embodiment of the container according to the invention as described here has the following dimensions:

The height of the container 1 is 234 mm and the greatest possible horizontal internal extent D inside the container 1 in the region of the vertical distance a between the two adjacent grooves 7, 8 (internal diameter of the cylindrical container 1 between two grooves 7, 8) is 85.9 mm. The lowermost first groove 7.4 is at a distance of 43.5 mm from the container base 3. A volume of 200 ml is enclosed between the container base 3, the side wall 2 and the plane 9.4. All further grooves 7, 8 are spaced apart from each other by 18.4 mm (corresponds to distance a). The volume enclosed by the planes 9, of second adjacent grooves 7, 8 and the side wall 2 is in each case 100 ml. As has been mentioned above, the volume enclosed by the lowermost plane 9.4, the container base 3 and side wall 2 is 200 ml, which corresponds to twice the volume (or the integer multiple of 2).

The depth t1 of the first grooves 7 is 4 mm, and the radius of the circle segment r of the first grooves 7 is 2 mm. This results in a ratio of the first groove depth t1 to the circle radius of the circle segment r of 2.0. The depth t2 of the second grooves 8 is 1 mm (t1>t2). The thickness d of the side wall 2 is 950 μm and is substantially constant at and between the grooves 7, 8. The ratio of the thickness d of the side wall 2 to the internal diameter of the side wall 2 between the grooves 7, 8 has a value of 0.01 in the present container 1 according to the invention.

In other illustrative embodiments of the container, the latter has different dimensions. In this way, it is possible to produce containers for different volumes, which containers are sufficiently stiff, despite having low material consumption, provide a scale for subvolumes and at the same time have optimized emptying and pouring properties.

In a further illustrative embodiment, the side wall 2 with the grooves 7, 8 is configured such that it is not deformed when there is a negative pressure in the enclosed container volume. It is sufficiently stiff. Even if there is a pressure of 1 atm (1013.25 bar), for example, acting on the side wall, the side wall 2 is not deformed. In particular, as regards material and thickness, the horizontal grooves 7, 8 are configured such that they are not deformed. In the case of a V shape or an elliptic shape of a groove 7, 8, there is the danger of the axially upper part and the axially lower part of the side wall 2, in relation to the groove 7, 8, being moved toward each other if there is a negative pressure, with the result that the enclosed container volume is reduced by the deformation of the groove 7, 8. In this case, the subvolumes between two grooves 7, 8 change according to the negative pressure, such that the grooves 7, 8 can no longer serve as a scale. This is avoided in the illustrative embodiment. The grooves can serve as a scale even when there is a negative pressure in the enclosed container volume, since there is no change of the subvolume between two grooves 7, 8.

LIST OF REFERENCE SIGNS

1 container
2 side wall
3 container base
4 shoulder
5 inner surface
6 recloseable opening
7.1 first groove
7.2 first groove
7.3 first groove
7.4 first groove
8.1 second groove
8.2 second groove
8.3 second groove
9.1 horizontal plane, defined by first groove 7.1
9.2 horizontal plane, defined by first groove 7.2
9.3 horizontal plane, defined by first groove 7.3
9.4 horizontal plane, defined by first groove 7.4
10.1 horizontal plane, defined by second groove 8.1
10.2 horizontal plane, defined by second groove 8.2
10.3 horizontal plane, defined by second groove 8.3
11 projection A axis
a vertical distance between two adjacent grooves 7, 8
D greatest possible horizontal internal extent
d thickness of the side wall 2
r radius of the circle of the circle segment of a groove 7
t1 depth of a first groove 7
t2 depth of a second grove 8

The invention claimed is:

1. A container with a side wall of plastic which encloses a container volume, wherein horizontally oriented grooves spaced vertically apart from one another are formed in the side wall, wherein the grooves comprise first grooves for stiffening the side wall, which first grooves have a first groove depth and are configured such that a projection protruding into the enclosed container volume is formed in the inner surface of the side wall, wherein the grooves moreover comprise second grooves which have a second groove depth, wherein the first groove depth is greater than the second groove depth, and wherein the first and second grooves are arranged such that at least one second groove is in each case arranged in the vertical direction between two first grooves, wherein the side wall and the horizontally oriented grooves of the side wall, with regard to the material and the thickness, are configured such that the side wall and the horizontally oriented grooves are not deformed when there is a negative pressure in the enclosed container volume, even if as a result of the negative pressure a pressure of 1 atm acts on the side wall and the horizontally oriented grooves, and subvolumes enclosed by two horizontal planes, which are defined by two adjacent grooves, and the side wall are in each case identical.

2. The container according to claim 1, wherein the side wall is transparent or translucent, at least in the region of the horizontally oriented grooves spaced vertically apart from one another.

3. The container according to claim 1, wherein the grooves form a scale for the volume received by the container, wherein the subvolume enclosed by a container base, the side wall and a horizontal plane defined by the lowermost groove is an integer multiple of the subvolume enclosed by two horizontal planes, which are defined by two adjacent grooves, and the side wall.

4. The container according to claim 1, wherein two adjacent first grooves are in each case at a vertical distance a from each other, wherein the condition $0.10\ D \leq a \leq 0.30\ D$ is met for the vertical distance a, wherein D is the greatest possible horizontal internal extent inside the container in the region of the vertical distance a between the two adjacent grooves.

5. The container according to claim 1, wherein the condition $0.01\ D \leq t1 \leq 0.10\ D$, is met for the first groove depth, wherein D is the greatest possible horizontal internal extent inside the container in the region of the vertical distance a between two adjacent grooves, and t1 is the first groove depth.

6. The container according to claim 1, wherein the condition $0.005\ D \leq t2 \leq 0.05\ D$, is met for the second groove depth, wherein D is the greatest possible horizontal internal extent inside the container in the region of the vertical distance a between two adjacent grooves, and t2 is the second groove depth.

7. The container according to claim 4, wherein the side wall of the container has a circular cross section, and D is the internal diameter of the side wall between the grooves.

8. The container according to claim 1, wherein the first grooves are arc-shaped at the first groove depth.

9. The container according to claim 1, wherein the first grooves have the contour of a circle segment at the first groove depth.

10. The container as claimed in claim 9, wherein the ratio of the first groove depth to the radius of the circle of the circle segment (r) of the first grooves is in a range of 1.5 to 2.5.

11. The container according to claim 1, wherein the projection, which is formed from one of the first grooves and which in the inner surface of the side wall protrudes into the enclosed container volume, has a rounded transition to the inner surface of the side wall.

12. The container according to claim 1, wherein each of the grooves is configured as a closed ring in the side wall.

13. The container according to claim 1, wherein the plastic from which the side wall is made is composed of high-density polyethylene (HDPE) or co-extruded plastic films (COEX).

14. The container according to claim 1, wherein the thickness (d) of the side wall is substantially constant at and between the grooves.

15. The container according to claim 1, wherein a recloseable opening is formed above the uppermost groove.

16. The container according to claim 4, wherein the condition $0.15\ D \leq a \leq 0.25\ D$, is met for the vertical distance a.

17. The container according to claim 5, wherein the condition $0.03\ D \leq t1 \leq 0.07\ D$, is met for the first groove depth.

18. The container according to claim 6, wherein the condition $0.01\ D \leq t2 \leq 0.03\ D$, is met for the second groove depth.

19. The container according to claim 5, wherein the side wall of the container has a circular cross section, and D is the internal diameter of the side wall between the grooves.

20. The container according to claim 6, wherein the side wall of the container has a circular cross section, and D is the internal diameter of the side wall between the grooves.

* * * * *